US005351420A

United States Patent [19]

Pozzobon et al.

[11] Patent Number: 5,351,420

[45] Date of Patent: Oct. 4, 1994

[54] SKI BOOT WITH A LEVER HAVING INDEPENDENT ADJUSTMENT DEVICES

[75] Inventors: Alessandro Pozzobon, Paderno di Ponzano Veneto; Roberto Gorza, Feltre; Renato Serafin, Vedelago, all of Italy

[73] Assignee: Nordica S.p.A., Montebelluna, Italy

[21] Appl. No.: 183,932

[22] Filed: Jan. 21, 1994

Related U.S. Application Data

[63] Continuation of Ser. No. 909,499, Jul. 6, 1992, abandoned, which is a continuation-in-part of Ser. No. 649,194, Feb. 4, 1991, Pat. No. 5,158,559, which is a continuation of Ser. No. 407,389, Aug. 18, 1989, abandoned.

[30] Foreign Application Priority Data

Aug. 31, 1988 [IT] Italy ..... 82581 A/88

[51] Int. Cl.[5] ..... A43B 5/04

[52] U.S. Cl. ..... 36/119; 36/50.5

[58] Field of Search ..... 36/117–121, 36/50.5, 109

[56] References Cited

U.S. PATENT DOCUMENTS

| | | | |
|---|---|---|---|
| 4,620,378 | 11/1986 | Sartor | 36/119 |
| 4,653,204 | 3/1987 | Morell et al. | 36/117 |
| 4,677,768 | 7/1987 | Benoit et al. | 36/119 |
| 4,719,670 | 1/1988 | Kurt | 36/119 |
| 4,719,709 | 1/1988 | Vaccari | 36/117 |
| 4,787,124 | 11/1988 | Pozzobon et al. . | |
| 4,811,503 | 3/1989 | Iwama | 36/119 |
| 4,908,965 | 3/1990 | Iwama | 36/119 |
| 5,048,204 | 9/1991 | Tacchetto et al. | 36/119 |
| 5,158,559 | 10/1992 | Pozzobon et al. | 36/119 |

FOREIGN PATENT DOCUMENTS 2536965 6/1984 France .

*Primary Examiner*—Paul T. Sewell
*Assistant Examiner*—Thomas P. Hilliard
*Attorney, Agent, or Firm*—Guido Modiano; Albert Josif; Daniel O'Byrne

[57] ABSTRACT

A ski boot comprising a shell inside which one or more pressers are provided, a front quarter connected to the shell, a rear quarter pivotally connected to the shell, a lever pivotally connected to the rear quarter, a cable winding device rotatably supported by the lever, a first cable connected to the winding device and engaging the foot presser, and a second cable interconnected between the quarters and the free end of the lever for closing the quarters, whereby the first cable passes through the pivoting axis of the lever, or through a sheath element interconnected between the lever and the shell, so that the actuation of the lever and the actuation of the winding device both only affect the appropriate cable and the securing provided by the other cable is completely unchanged.

4 Claims, 2 Drawing Sheets

SKI BOOT WITH A LEVER HAVING INDEPENDENT ADJUSTMENT DEVICES

This is a continuation application of application Ser. No. 07/909,499 filed on Jul. 6, 1992, now abandoned; which is in turn a continuation-in-part application of application Ser. No. 07/649,194 filed on Feb. 4, 1991, now U.S. Pat. No. 5,158,559; which in turn is a continuation application of application Ser. No. 407,389 filed on Aug. 18, 1989, now abandoned.

BACKGROUND OF THE INVENTION

The present invention relates to a ski boot, particularly of the rear-entry type, therefore composed of a shell with which a front quarter and a rear quarter are associated.

Said boot furthermore comprises inside its shell one or more pressers which are adapted, upon activation thereof, to optimally secure the foot inside said shell.

In said known kind of boot, the problem of achieving the optimum adjustment and securing of the quarters and of the foot inside the shell is currently strongly felt.

Many devices are therefore known which individually achieve the above mentioned purpose, but high costs and an overloading of the boot structure are observed indeed because this purpose is achieved by means of physically separate devices which are therefore differently located at the boot.

As a partial solution to this disadvantage, French patent application, No. 2536965 filed on Dec. 2, 1982, discloses a securing and locking device for rear-entry ski boots, constituted by a single cable which affects the foot instep region, embraces the quarters and can be locked by means of an adapted lever.

Though this device allows to simultaneously close the quarters and secure the foot inside the boot, the two functions are interdependent, and it is therefore impossible to vary the degree of securing of the quarters with respect to that of the foot instep.

Such a need is instead strongly felt in order to achieve the optimum wear of the boot. U.S. Pat. No. 4,653,204 also discloses a ski boot comprising a vertical lever which is pivoted to the rear quarter and comprises means for adjusting the closure of the quarters and the securing of the foot comprising epicycloidal gears adapted to differently wind separate cables which affect the quarters and a presser arranged inside the shell.

Even this solution, however, entails the simultaneous activation of the two functions by rotating said lever, and no adjustment is possible, either to close the quarters or to secure the foot, when the lever is activated.

Said boot therefore allows a different winding of the cables only when the vertical lever is opened, and no mutually independent activations, for example of the closure of the quarters or of the securing of the foot, are possible.

Still as a partial solution to these disadvantages, U.S. Pat. No. 4,787,124 discloses a multiple-function actuation device which comprises means adapted to selectively engage a knob and the ends of a first shaft and of a second shaft, said shafts being mutually free and coaxial.

Each of said shafts furthermore had, at its other end, a gear coupled by means of adapted kinematic systems respectively to a winding pulley for a cable and with a winder for a band or the like.

The pulley and the winder were furthermore arranged along mutually perpendicular axes and cooperated with means adapted to allow the removable locking of their rotation in the unwinding direction of the cable and of the band.

Though this device allows to independently activate the two functions, it is very complicated from a structural and constructive point of view and entails hardly negligible dimensions and high overall costs.

The fact is furthermore stressed that said device does not memorize a selected securing degree for one of the functions.

SUMMARY OF THE INVENTION

The aim of the present invention is therefore to eliminate the disadvantages described above in known types by providing a device which can be applied to a boot and allows the skier to rapidly and easily achieve at least two different functions, such as for example the adjustment and/or the securing of the quarters and of the foot, said device being structurally simple and compact.

Within the scope of the above described aim, an important object is to provide a device which is simple to apply and harmonizes excellently with the boot, and in which the skier can indifferently achieve the two functions.

Not least object is to provide a device which associates the preceding characteristics with the important characteristic of having modest costs and optimum industrialization, which can be obtained with conventional means and with known machinery.

This aim, these objects and others which will become apparent hereinafter are achieved by a ski boot, comprising a shell having a front quarter and a rear quarter and footpressers therein, characterized in that it comprises a lever body pivoted to one of said quarters and has independently activatable adjustment and securing devices for said front and rear quarters and said pressers arranged inside said shell.

One of said devices advantageously comprises a first traction element which passes at the pivoting axis of the lever body, and the rotation of said lever body does not affect the degree of tension of said first element.

BRIEF DESCRIPTION OF THE DRAWINGS

Further characteristics and advantages of the invention will become apparent from the detailed description of two particular but not exclusive embodiments, illustrated only by way of non-limitative example in the accompanying drawings, wherein.

DESCRIPTION OF THE PREFERRED EMBODIMENTS

Figure 1:
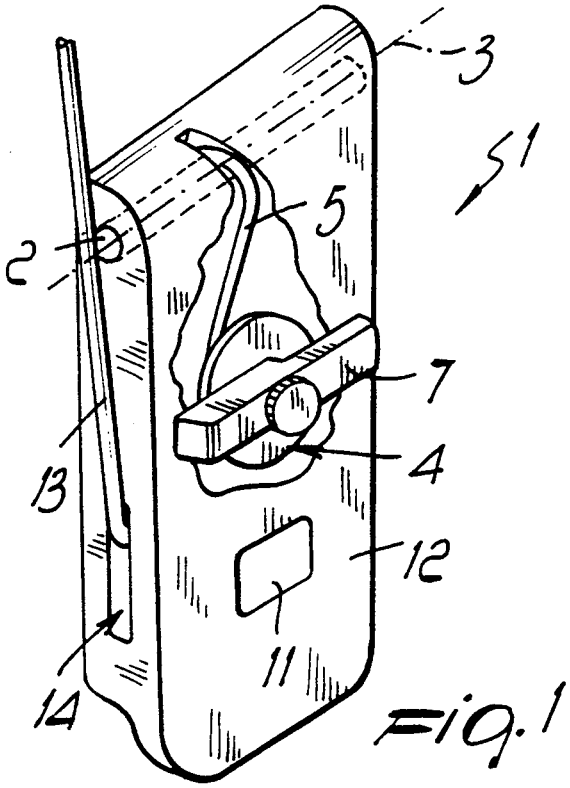
FIG. 1 is an isometric view of a first embodiment of the device.
Figure 2:
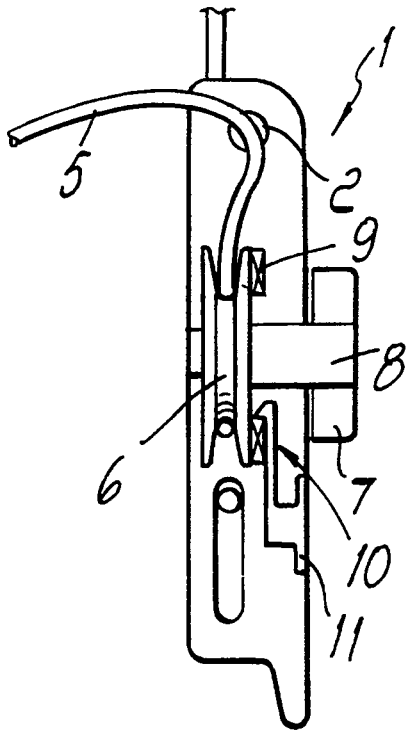
FIG. 2 is a partially sectional side view of the device of FIG. 1.

With reference to the above described figures, the reference numeral 1 indicates a lever body which has an essentially rectangular shape.

Said lever body is rotatably associated, at one of its ends, with a ski boot by means of at least one pivoting pin 2, the axis 3 whereof is arranged perpendicular to said lever body 1.

First devices, indicated by the reference numeral 4, for example for adjusting and/or securing one or more pressers arranged inside the shell of a ski boot, are associated with said lever body 1.

Said first devices comprise a first traction element 5 constituted by a first cable guided on the lever body at the pivoting pin 2 along a direction which is approximately perpendicular to the axis 3.

Said first traction element 5 furthermore interacts with an element for temporarily winding it, preferably constituted by a pulley 6 which is rotatably associated at an adapted seat provided on said lever body 1 and can be actuated for example by means of an adapted knob 7 connected thereto by means of an adapted shaft 8.

Means are furthermore provided for temporarily deactivating a one-way motion which can be imparted to the pulley 6 by means of said knob.

Said means are constituted by a toothed crown 9 which is associated with the pulley 6 and interacts in a ratchet-like manner with a tooth 10 which can be disengaged from the toothed crown 9 by means of an adapted pushbutton 11 which can be activated by the skier and is pivoted to the lever body 1.

The other end of the first traction element 5 is guided on the boot at said one or more pressers arranged inside the shell, so that the activation of the knob 7 provides an adjustment and/or securing at said pressers.

Second devices 12 are furthermore provided, for example to adjust and/or secure the front and rear quarters of a ski boot, and comprise a second traction element 13 which is associated at its ends, for example, with the front quarter, is guided at the rear quarter and passes through an adapted seat 14 provided transversely to the lever body 1 on the opposite side with respect to the pivoting pin 2.

Possible systems for adjusting the tension of the second traction element may be applied directly at the lever body 1 or on the front and/or rear quarters of the boot.

By virtue of the arrangement of the first and second traction elements, the two functions can be activated independently of one another.

The arrangement of the first traction element 5, which passes at the axis 3 of the pivoting pin 2 of the lever body 1, allows in fact not to vary for example the degree of tension imparted to the first traction element 5 by means of the hob 7 when the second devices 12 are activated and the lever body 1 therefore rotates.

Vice versa, it is possible to adjust the tension of the first traction element 5 independently from the preset tension of the second traction element 13.

The two functions are therefore by all means separate though they are controlled by a centralized element.

It has thus been observed that the invention achieves the intended aim and objects, allowing to activate two separate functions in a rapid and easy manner using a single lever body, the activation of said functions being independent from the condition of one another.

The particular arrangement of the first traction element at the lever body furthermore provides a very compact structure which allows excellent integration in both ergonomic and aesthetic terms, by virtue of a very small occupied area, though the total independence of the two functions is preserved.

It is furthermore observed that the overall costs are very low.

The invention is naturally susceptible to numerous modifications and variations, all of which are within the scope of the same inventive concept.

Figure 3:
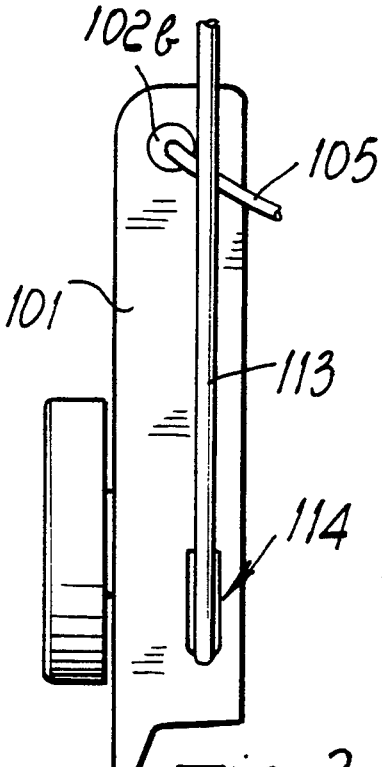
FIG. 3 is a side view of a second embodiment.
Figure 4:
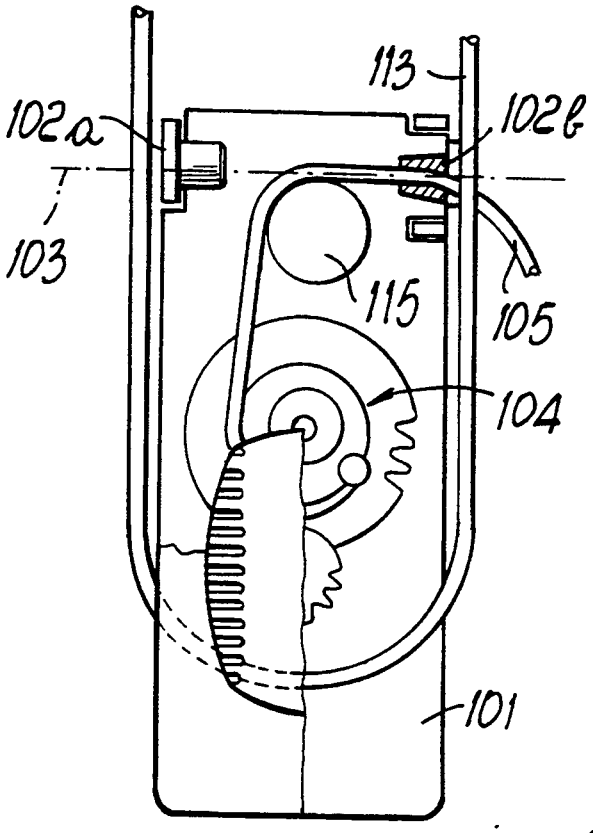
FIG. 4 is a partially sectional plan view of a second embodiment.

Thus for example FIGS. 3 and 4 illustrate a lever body 101, an end whereof is articulated to the boot by means of a pair of pivoting pins 102*a* and 102*b*.

The first traction element 105, which interacts with first devices 104 associated with the lever body 101, is guided at the axis 103 of the pivoting pins 102*a* and 102*b* on a pin or small pulley 115.

The first traction element 105 subsequently passes axially with respect to the pivoting pin 102*b* and then protrudes laterally to the lever body 101 and is then for example guided inside the boot.

The second devices again comprise a second traction element 113 which passes transversely to the lever body 101 at an adapted transverse seat 114.

In this case, too, any rotation imparted to the lever body 101 does not affect the degree of tension imparted to the first traction element 105, as said first traction element is arranged at the axis 103 of the pivoting pins 102*a* and 102*b*.

The two functions can therefore again be activated independently from one another, and the degree of tension imparted to the respective traction element, when the other function is deactivated or not, remains stored for each function.

Figure 5:
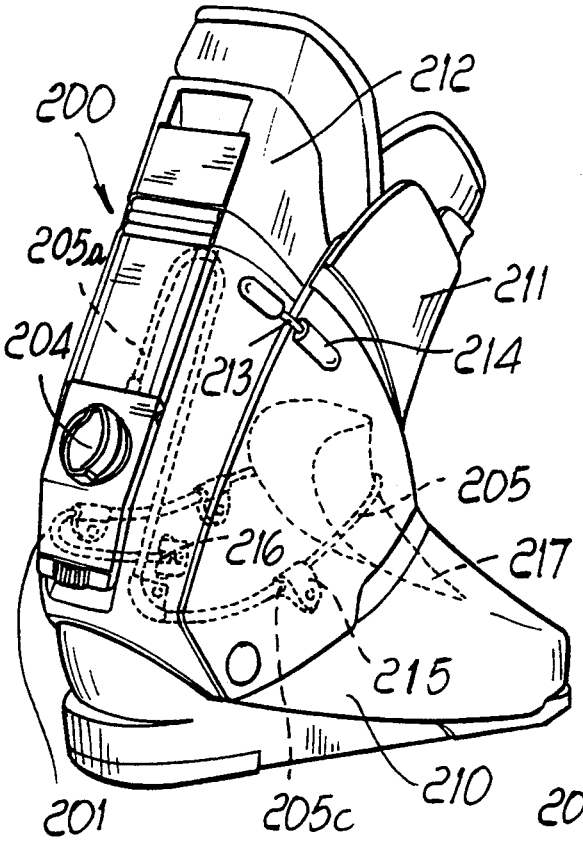
FIG. 5 is an isometric rear view of a ski boot comprising a device according to a further aspect of the invention.
Figure 6:
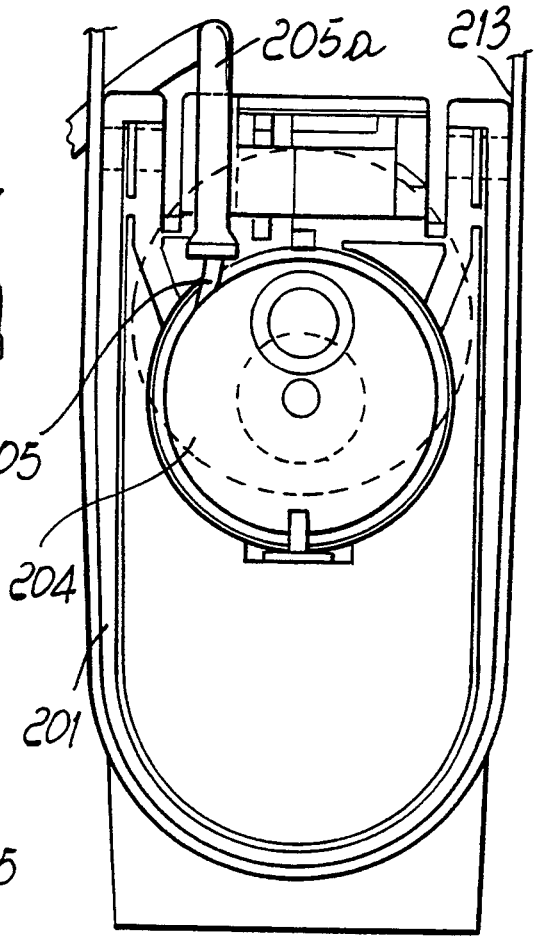
FIG. 6 is a partially sectioned front view of the device of FIG. 5.
Figure 7:
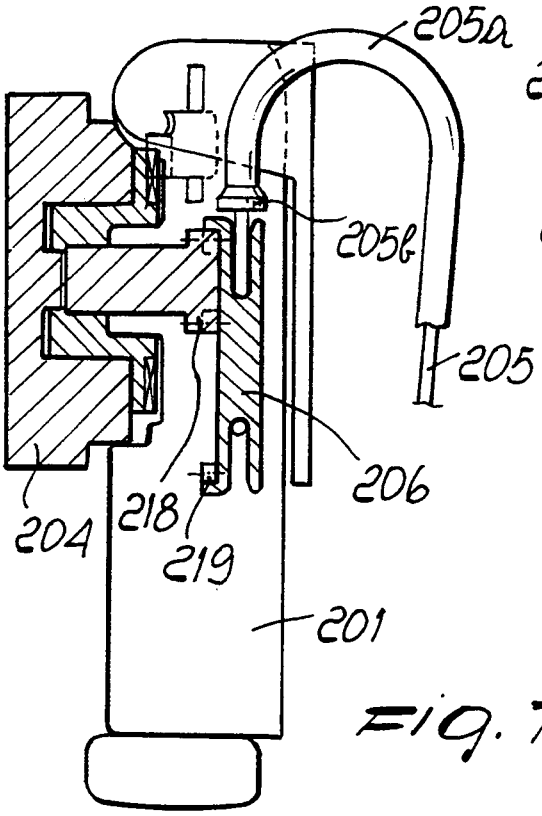
FIG. 7 is a side sectioned view of the device of FIGS. 5 and 6.

FIGS. 5–7 illustrate a ski boot 200 comprising a securing device according to a further aspect of the invention.

The ski boot 200, of the rear-entry type, comprises a shell 210, a front quarter 211 connected to the shell, and a rear quarter 212 pivotally connected to the shell. The rear quarter is therefore adapted to pivot rearwardly from the front quarter to allow a user to insert his lower leg in the boot.

A lever 201 is pivotally connected to the ski boot, particularly at the rear quarter 212 thereof. Such lever 201 rotatably supports a winding device for winding a first traction element or first cable 205 which engages or wraps around at least one foot presser, in particular a foot instep presser 217, arranged inside the boot. As seen in FIG. 7, the winding device comprises a pulley 206 to which a first end of the cable 205 is connected, and a rotatable knob 204 which is adapted to rotate the pulley by means of gears 218 and 219.

A second traction element or second cable 213 has it ends rigidly connected to the front quarter 211 at opposite sides thereof (one connection point is shown at 214 in FIG. 5). The second traction element is slidable guided in the rear quarter and is connected to the end of the lever opposite to its pivoting end as seen in FIG. 6. Thus a pivoting actuation of the lever alternately closes the rear quarter to the front quarter or allows the rear quarter to pivot rearwardly into an open position.

A sheath 205*a* is provided in which the first cable 205 is slidably guided. The sheath 205*a* has a first end 205*b* rigidly connected to the lever 201, and a second end 205*c* rigidly connected to a first connection element 215 which is in turn rigidly connected to a fixed portion of the boot i.e. to the shell or to the front quarter. The second end 216 of the first cable 205 is also rigidly connected to a fixed portion of the boot such as the shell or the front quarter.

The provision of a sheath 205*a* in the ski boot in a manner as described above ensures that the two traction elements are absolutely independent in their adjustment. That is, a pivoting of the lever 201 only affects the adjustment of the second traction element for the securing of the quarters while the action of the first traction element on the foot presser is completely unchanged, and any actuation of the winding device only affects the adjustment of the first traction element and the degree of securing of the quarters is completely unchanged.

The dimensions and the materials constituting the individual components of the invention may furthermore naturally be the most appropriate according to the specific requirements.

We claim:

1. A ski boot comprising: a shell; a front quarter connected to said shell; a rear quarter pivotally connected to said shell; a lever element having a first end which is pivotally connected to said rear quarter; at least one foot presser arranged inside the ski boot; a winding device supported by said lever; a first traction element having a first end which is connected to said winding device, the first traction element further having a middle portion engaging with said foot presser, and the first traction element further having a second end which is connected to a fixed portion of the ski boot; a second traction element interconnected between said front quarter and a second end of said lever which is opposite to said first end of said lever thereby for closing said front and rear quarters; and a flexible sheath element in which is slidably accommodated said first traction element, said sheath element having a first end which is rigidly connected to said lever and a second end which is rigidly connected to a fixed part of the ski boot, and said winding device having exclusively only the first traction element of said first and second traction elements connected thereto.

2. A ski boot according to claim 1, wherein said second end of said flexible sheath element is rigidly connected to said shell.

3. A ski boot according to claim 1, wherein said second end of said flexible sheath element is rigidly connected to said front quarter.

4. A ski boot according to claim 1, wherein said winding device comprising a pulley element rotatably supported by said lever to which said first end of said first traction element is connected, and a knob element rotatably supported on said lever for rotating said pulley element by gear means.

* * * * *